US007465121B1

(12) United States Patent
Hendricks et al.

(10) Patent No.: US 7,465,121 B1
(45) Date of Patent: Dec. 16, 2008

(54) VIBRATING CONCRETE HAND TROWEL

(76) Inventors: Chad Hendricks, 621 Irvin Ave., Apt. B, Bemidji, MN (US) 56601; Christopher Pawlowski, 956-12th St., NW., Apt. 314, Forest Lake, MN (US) 55025

( * ) Notice: Subject to any disclaimer, the term of this patent is extended or adjusted under 35 U.S.C. 154(b) by 69 days.

(21) Appl. No.: 11/825,697

(22) Filed: Jul. 10, 2007

(51) Int. Cl.
*E01C 19/38* (2006.01)

(52) U.S. Cl. ..... 404/114; 404/118; 15/235.4

(58) Field of Classification Search ..... 404/97, 404/114, 118; 15/235.4
See application file for complete search history.

(56) References Cited

U.S. PATENT DOCUMENTS 4,653,957 A * 3/1987 Smith et al. ..... 404/114
5,632,569 A * 5/1997 Szmansky ..... 404/97
6,013,972 A * 1/2000 Face et al. ..... 310/332
6,139,217 A * 10/2000 Reuter ..... 404/97
2005/0036837 A1 * 2/2005 Marshall ..... 404/114

FOREIGN PATENT DOCUMENTS

JP 64-21168 * 1/1989
JP 64-24958 * 1/1989
JP 2005-351058 * 12/2005

* cited by examiner

*Primary Examiner*—Gary S Hartmann
(74) *Attorney, Agent, or Firm*—Thomas B. Tate

(57) ABSTRACT

A hand trowel for vibrating concrete in order to smooth the concrete. The trowel has a blade, a handle mounted on the blade, and electrical components including a motor inside the handle. When the switch is turned on, the motor causes the handle to vibrate, which in turn transmits vibrations to the blade and to the concrete surfaces that come in contact with the blade.

1 Claim, 2 Drawing Sheets

VIBRATING CONCRETE HAND TROWEL

BACKGROUND OF THE INVENTION

The field of the invention is hand trowels for smoothing concrete, specifically hand trowels that vibrate the concrete.

When poured concrete is used in building construction, for example, for footings, poured walls, and humps around plumbing pipes in the basement, it is necessary to smooth the concrete to release air bubbles that may be in the concrete, in order to achieve a finish having a smooth creamy consistency. At present this is done by hand, using a conventional non-vibrating hand trowel to smooth the concrete, which is a slow and laborious process. No vibrating hand trowels are known to be on the market.

SUMMARY OF THE INVENTION

The invention is a vibrating hand trowel for smoothing concrete. The electrical components for creating vibration are located in the handle. When the switch is turned on, the motor is turned on, and because the motor has an actuator located inside a casing, vibration is transferred to the whole handle, then to the trowel blade, which then transfers the vibration to the concrete.

An advantage of the invention is that it can be used to level the concrete around plumbing pipes to avoid mounding, and this eliminates the need to cut studs in a special way to avoid the humps.

Another advantage of the invention is that when concrete is settling, it helps to bring the cream to the top in hot weather.

Another advantage of the invention is that it allows concrete to be smoothed faster than by conventional hand troweling because the vibration disperses the air bubbles in the concrete.

DETAILED DESCRIPTION OF THE INVENTION

Figure 1:
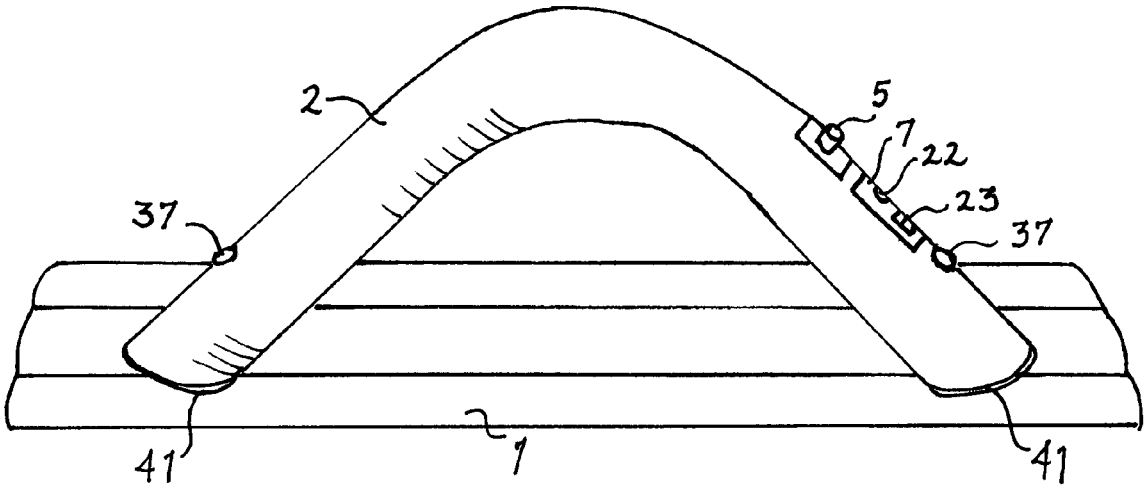
FIG. 1 is a side view of the invention.

The vibrating concrete hand trowel has a blade 1, a handle 2 mounted onto the blade 1, and electrical components including a motor 3, a battery 4, a switch 5, and a charger 7 disposed inside the handle 2, the switch 5 and the charger 7 also projecting through to the outside surface of handle 2.

The trowel blade 1 is a long horizontal blade made of metal, preferably magnesium. The blade 1 has a top surface upon which the handle 2 is mounted and a generally flat bottom surface that contacts the concrete surface to be smoothed when the trowel is in use.

The handle 2, which is preferably made of plastic, is generally arcuate in shape with the highest point being positioned above the center of blade 1. Internally the handle 2 is hollow, defining a chamber 11 into which the electrical components are disposed, and is wider in diameter than the average trowel handle in order to accommodate the electrical components. The handle 2 is made in halves, the split running the full length of the handle 2, in order to allow installation of the electrical components. After the electrical components are in place, the two halves of handle 2 are joined together by epoxy, and may additionally be held together by three screws (not shown), positioned at each end and in the center of handle 2. Externally the handle 2 has an indentation formed near each end through which a pan head screw or bolt 37 is disposed vertically into a corresponding bolt hole in the top surface of blade 1 in order to hold the handle 2 onto the blade 1 at both ends. The bolts 37 each also penetrate a rubber or hard plastic washer 41 fitted underneath the handle 2 and on top of the blade 1, the washers 41 acting as sealants to prevent water from getting in between the handle 2 and the blade 1.

Figure 2:
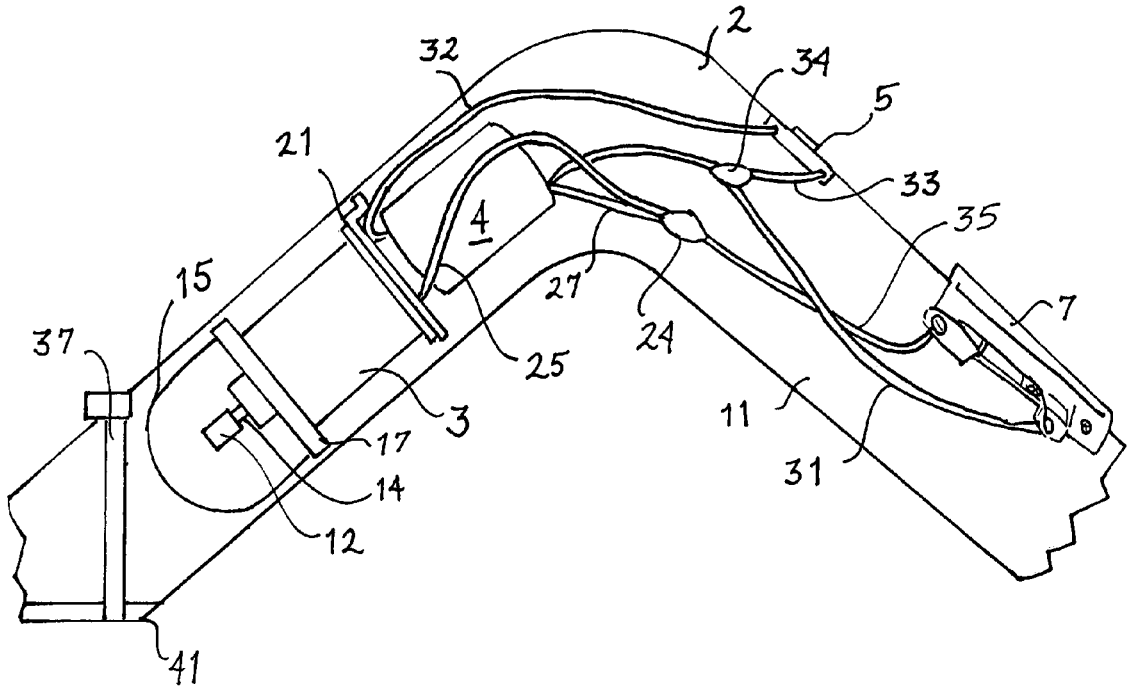
FIG. 2 is a sectional view, taken from the same side as FIG. 1, showing the half of the handle that contains the internal electrical components, said half being the back half as seen from the perspective in FIG. 1.

The motor 3 is a standard type of gas-proof motor that can operate even if wet. An actuator 12, also known as a thumper, is attached to the pin 14 of the motor 3, and replaces the conventional gear of the motor. The actuator 12 is surrounded by a casing 15 that allows air flow into the motor 3. The casing 15 is shown in FIG. 2 as if it were transparent in order to show the actuator 12 and pin 14 inside, but actually the casing 15 will usually be opaque. A rubber gasket 17 fits between the casing 15 and the motor 3, and a bracing 21 is positioned at the opposite end of the motor 3.

The battery 4, which is preferably a seven point four volt battery, supplies power to the motor 3. The switch 5 is an on-off push button switch that preferably is inset into the handle 2. The charger 7 is a plate that has contacts on its bottom surface in the interior of handle 2, and on its top surface on the outside of handle 2 it has a small circular opening 22 to receive the plug-in cord of a conventional charging device (not shown) such as the type used to recharge a remote control model airplane. Also mounted on charger 7 is a switch 23 which can be slid horizontally to close opening 22 when the charging device is unplugged, in order to prevent water from entering the charger 7. The charging device runs on six AAA batteries that provide at least twenty-five charges. The battery 4 will stay charged for about thirty-five minutes.

Wiring connects the various electrical components. A three-way connector 24 connects wire 25 to motor 3, wire 27 to battery 4, and wire 31 to charger 7. Wire 32 connects from motor 3 to switch 5. Wire 33 connects from battery 4 to switch 5 through a three-way connector 34. Wire 35 connects from the three-way connector 34 to charger 7.

To use the invention, switch 5 is turned on, which turns on motor 3, which transmits vibration to handle 2, which transmits vibration to blade 1, which transmits vibration to the concrete that is in contact with the bottom surface of blade 1. Normally it will take about five to ten minutes to vibrate the concrete to the desired smoothness.

We claim:

1. A hand trowel for vibrating concrete, said trowel comprising:

a blade having a top surface and a generally flat bottom surface;

a generally arcuate handle mounted onto said top surface of said blade and formed so that the highest point of the arch is positioned above the center of said blade, said handle being connected to said blade at each end, said handle having a hollow internal chamber;

means for creating vibration in said handle, said vibration being transferred from said handle to said blade and then to any concrete surface that comes into contact with said bottom surface of said blade, said means for creating vibration comprising electrical components including a motor disposed within said hollow internal chamber of said handle, said motor having an actuator contained within a casing, a battery disposed within said chamber, an on-off switch mounted on said handle, a charger mounted on said handle, wiring connecting said motor to said switch, wiring connecting said battery to said motor and to said charger through a three-way connector, and wiring connecting said battery to said switch and to said charger through another three-way connector, said means for creating vibration in said handle being positioned in spaced relationship to said blade.

* * * * *